US011358155B2

(12) United States Patent
Höglund

(10) Patent No.: US 11,358,155 B2
(45) Date of Patent: Jun. 14, 2022

(54) EXCHANGEABLE SEPARATION INSERT AND MODULAR CENTRIFUGAL SEPARATOR

(71) Applicant: Alfa Laval Corporate AB, Lund (SE)

(72) Inventor: Kasper Höglund, Rönninge (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 17/296,607

(22) PCT Filed: Dec. 9, 2019

(86) PCT No.: PCT/EP2019/084148
§ 371 (c)(1),
(2) Date: May 25, 2021

(87) PCT Pub. No.: WO2020/120364
PCT Pub. Date: Jun. 18, 2020

(65) Prior Publication Data

US 2022/0001396 A1 Jan. 6, 2022

(30) Foreign Application Priority Data

Dec. 10, 2018 (EP) ..... 18211240
Dec. 10, 2018 (EP) ..... 18211241
Sep. 25, 2019 (EP) ..... 19199431

(51) Int. Cl.
*B04B 1/08* (2006.01)
*B04B 7/08* (2006.01)
(Continued)

(52) U.S. Cl.
CPC ..... *B04B 1/08* (2013.01); *B04B 7/08* (2013.01); *B04B 7/14* (2013.01); *B04B 9/12* (2013.01); *B04B 11/02* (2013.01)

(58) Field of Classification Search
CPC .... B04B 1/08; B04B 7/08; B04B 9/12; B04B 11/02
(Continued)

(56) References Cited

U.S. PATENT DOCUMENTS

2009/0280974 A1* 11/2009 Klintentedt ..... B04B 7/00 494/41
2011/0319248 A1 12/2011 Starbard
(Continued)

FOREIGN PATENT DOCUMENTS

EP 3 384 993 A1 10/2018
EP 3384993 A1 * 10/2018 ..... B04B 7/00
(Continued)

OTHER PUBLICATIONS

International Search Report, issued in PCT/EP2019/084148, dated Feb. 13, 2020.
(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

An exchangeable separation insert and a modular centrifugal separator are disclosed. The insert includes a rotatable rotor casing and a first stationary portion. The rotor casing delimits a separation space and includes frustoconical separation discs. The first stationary portion is biased in a first direction away from the rotor casing along an axial direction.

20 Claims, 4 Drawing Sheets

(51) Int. Cl.
*B04B 9/12* (2006.01)
*B04B 11/02* (2006.01)
*B04B 7/14* (2006.01)

(58) Field of Classification Search
USPC ..... 494/41
See application file for complete search history.

(56) References Cited

U.S. PATENT DOCUMENTS

| | | | | |
|---|---|---|---|---|
| 2016/0184836 | A1 | 6/2016 | Mackel et al. | |
| 2017/0189915 | A1 | 7/2017 | Mackel et al. | |
| 2017/0203306 | A1* | 7/2017 | Penkl | B04B 7/02 |

FOREIGN PATENT DOCUMENTS

| | | | |
|---|---|---|---|
| WO | WO 2014/000829 | A1 | 1/2014 |
| WO | WO 2015/181175 | A2 | 12/2015 |
| WO | WO 2015/181177 | A1 | 12/2015 |

OTHER PUBLICATIONS

Written Opinion of the International Searching Authority, issued in PCT/EP2019/084148, dated Feb. 13, 2020.

* cited by examiner

EXCHANGEABLE SEPARATION INSERT AND MODULAR CENTRIFUGAL SEPARATOR

TECHNICAL FIELD

The invention relates to an exchangeable separation insert for a modular centrifugal separator. The invention further relates to a modular centrifugal separator.

BACKGROUND

In the field of pharmaceuticals, biopharmaceuticals, biotechnology and thereto related fields separation of substances from a liquid mixture, such as separation of cells from a cell culture, are performed in a sterile environment. Traditionally, equipment made e.g. from stainless steel has been used, which equipment is sterilised between batches.

Lately, disposable separation equipment made for single use, i.e. for one batch or a limited number of batches, has been suggested. For instance, US2011/0319248 discloses a single use centrifuge and WO 2015/181177 discloses a separator comprising an exchangeable inner drum.

WO 2015/181177 discloses a separator for the centrifugal processing of a flowable product comprising a rotatable outer drum and an exchangeable inner drum arranged in the outer drum. The inner drum comprises means for clarifying the flowable product. The outer drum is driven via a drive spindle by a motor arranged below the outer drum. The inner drum extends vertically upwardly through the outer drum with fluid connections arranged at an upper end of the separator.

SUMMARY

An exchangeable separation insert of a modular centrifugal separator requires secure positioning within a stationary frame and a rotatable member of the modular centrifugal separator.

It is an object of the invention to provide an exchangeable separation insert which is configured to be securely positioned within a modular centrifugal separator.

According to an aspect of the invention, at least one of the above mentioned objects is achieved by an exchangeable separation insert for a modular centrifugal separator. The exchangeable separation insert comprises a rotor casing rotatable about an axis of rotation and a first stationary portion. The rotor casing delimits a separation space and comprises frustoconical separation discs arranged in the separation space. A first fluid passage extends through the first stationary portion into the separation space. The axis of rotation extends along an axial direction and the rotor casing has a first axial end portion and a second axial end portion. The first stationary portion is arranged at the first axial end portion. The first stationary portion is biased in a first direction away from the rotor casing along the axial direction.

Since the first stationary portion is biased in a first direction away from the rotor casing along the axial direction, the exchangeable separation insert is configured for being compressed by positioning the first stationary portion towards the rotor casing in a second direction opposite to the first direction, i.e. against the bias. The bias of the first stationary portion in the first direction, will contribute to securely position the exchangeable separation insert within the modular centrifugal separator when mounted therein. Thus, the above object is achieved.

It is a further object of the invention to provide for a modular centrifugal separator comprising a securely positioned exchangeable separation insert.

According to a further aspect of the invention, at least one of the above mentioned objects is achieved by a modular centrifugal separator configured for separating a liquid feed mixture into a heavy phase and light phase. The modular centrifugal separator comprises an exchangeable separation insert according to any one of aspects and/or embodiments discussed herein and a base unit. The base unit comprises a stationary frame, a rotatable member, and a drive unit for rotating the rotatable member. The rotor casing of the exchangeable separation insert is releasably engaged inside the rotatable member, and the first stationary portion is releasably engaged with the stationary frame. The first stationary portion is arranged in a first proximal position along the axial direction, counter to the bias in the first direction. The first proximal position is closer to the rotor casing than a first distal end position of the first stationary portion provided in an unmounted state of the exchangeable separation insert.

Since, the exchangeable separation insert is configured for being compressed by positioning the first stationary portion, against the bias, towards the rotor casing in a second direction opposite to the first direction, and since the first stationary portion is arranged in a first proximal position along the axial direction, counter to the bias in the first direction, the bias of the first stationary portion in the first direction, will contribute to securely position the exchangeable separation insert within the stationary frame and the rotatable member in the base unit of the modular centrifugal. Thus, the above mentioned further object is achieved.

The modular centrifugal separator may comprise two main parts, the base unit and the exchangeable separation insert. The base unit may comprise basic components for supporting and rotating the exchangeable separation insert such as the above mentioned stationary frame and rotatable member. The exchangeable separation insert may be configured for the actual separation of the liquid feed mixture to take place in the separation space thereof. The liquid feed mixture may flow via one fluid connection into the separation space and the separated heavy and light phases may leave the separation space via one fluid connection each. The first fluid passage may form part of one of the fluid connections.

The exchangeable separation insert may be configured for single use, i.e. for separation of one batch only or a limited number of batches of liquid feed mixture. The base unit on the other hand may be configured for repeated use with different exchangeable separation inserts, i.e. the base unit may be used for the separation of numerous batches of liquid feed is mixture using different exchangeable separation inserts.

When the modular centrifugal separator is in an assembled state, the rotor casing of the exchangeable separation insert is engaged inside the rotatable member, and the first stationary portion is engaged with the stationary frame. As mentioned above, both the rotatable member and the first stationary portion are releasably engaged, and thus, the exchangeable separation insert may be exchanged for a new and used exchangeable separation insert after separation of a batch of liquid feed mixture. The first stationary portion is arranged in the first proximal position when the exchangeable separation insert is mounted in the base unit. Before and after being mounted in the base unit, due to the bias, the first stationary portion is arranged in the first distal end position. As mentioned above, the bias in the first direction contributes to securing the exchangeable separation insert in the base unit. Further means and/or measures for securing the exchangeable separation insert in the base unit may be provided, such as e.g. engaging means between the rotor casing and the rotatable member, engaging means between the first stationary portion and the stationary frame, etc.

Herein the term bias/biased is synonymous with the term pretension/pretensioned.

The exchangeable separation insert may be configured to form the only part of the modular centrifugal separator, which is in contact with the liquid feed mixture, and the separated heavy and light phases. Thus, the exchangeable separation insert may be provided to a user as a sterile entity. The sterile entity may include parts configured for separating the liquid feed mixture as well as conduits for the liquid feed mixture and the separated heavy and light phases. The exchangeable separation insert is mounted in the base unit by the user. Thus, the user will readily have available a centrifugal separator with a sterile environment for separation of the liquid feed mixture.

The rotatable member may be rotatably supported in the stationary frame. The rotatable member may be supported in the stationary frame without the aid of a spindle or other kind of rotor shaft. The stationary frame is stationary in the sense that it is stationary during use of the modular centrifugal separator while the rotatable member is configured to rotate together with the rotor casing during use of the modular centrifugal separator.

When the exchangeable separation insert is mounted in the base unit, the rotor casing may be received in an inner space of the rotatable member. Suitably, the rotatable member may be provided with an opening at a first axial end of the rotatable member for at least one fluid connection of the exchangeable separation insert to extend therethrough.

The exchangeable separation insert may further comprise a second stationary portion provided with a second fluid passage. Accordingly, the rotatable member may be provided with an opening at an opposite second axial end thereof. At least one fluid connection of the exchangeable separation insert may extend through the opening at the second axial end of the rotatable member.

According to embodiments, the first stationary portion may comprise a first set of springs, the first set of springs comprising at least one spring element. The at least one spring element of the first set of springs may be arranged in the first stationary portion such that when energy is stored in the at least one spring element of the first set of springs, the first stationary portion is biased in the first direction away from the rotor casing along the axial direction. In this manner, the bias of the first stationary portion in the first direction may be achieved.

Throughout this disclosure, a spring element may be e.g. a compression spring or an extension spring. As is commonly known, energy is stored in a spring element by displacing at least a portion of the spring element from its equilibrium position, i.e. e.g. by compressing a compression spring, and by extending an extension spring.

According to embodiments, the exchangeable separation insert may comprise a first sealing member, wherein the first sealing member seals the first fluid passage in a transition between the first stationary portion and the rotor casing. In this manner, a mechanical hermetical seal of the first fluid passage may be provided between the rotor casing and the first stationary portion. For instance, if the first fluid passage forms part of an inlet for the liquid feed mixture, the first sealing member may provide a mechanically hermetically sealed inlet of the modular centrifugal separator.

According to embodiments, the first sealing member may comprise a first stationary sealing element provided with a first stationary sealing surface arranged in the first stationary portion and a first rotatable sealing element provided with a first opposite sealing surface arranged in the rotor casing. The first stationary sealing surface may abut against the first opposite sealing surface. In this manner, a mechanical hermetical seal may be provided.

According to embodiments, the first stationary portion may be axially displaceable in relation to the first stationary sealing element. The at least one spring element of the first set of springs may be arranged between the first stationary portion and the first stationary sealing element such that when energy is stored in the at least one spring element of the first set of springs, the first stationary portion is biased in the first direction away from the rotor casing along the axial direction and the first stationary sealing element is pressed against the first rotatable sealing element. In this manner, sealing abutment between the first stationary sealing element and the first rotatable sealing element may be achieved. More specifically, in this manner sealing abutment between the first stationary sealing surface and the first opposite sealing surface may be ensured in order to provide a mechanical hermetical seal of the first fluid passage. At the same time the bias of the first stationary portion in the first direction away from the rotor casing may be achieved, which may contribute to positioning the exchangeable separation insert within the base unit of the modular centrifugal separator, as discussed above.

According to embodiments, the exchangeable separation insert may comprise a first stop mechanism for preventing the first stationary portion from being biased in the first direction away from the rotor casing along the axial direction beyond a first distal end position. In this manner, it may be ensured that exchangeable separation insert may be handled as one unit. The first stop mechanism may prevent the first stationary portion from being separated from the rotor casing, which might otherwise occur due to the bias of the first stationary portion in the first direction. Accordingly, also in the first distal position, the first stationary portion may be biased in the first direction away from the rotor casing.

According to embodiments, the exchangeable separation insert may comprise a second stationary portion, wherein a second fluid passage may extend through the second stationary portion into the separation space. The second stationary portion may be arranged at the second axial end portion of the rotor casing. The second stationary portion may be biased in a second direction away from the rotor casing along the axial direction. In this manner, a further fluid connection to or from the separation space may be provided at the second axial end portion of the rotor casing, opposite to the first axial end portion. Moreover, since the second stationary portion may be biased in the second direction, the exchangeable separation insert is configured for being compressed by positioning the second stationary portion towards the rotor casing in the first direction opposite to the second direction, i.e. against the bias in the second direction. The bias of the second stationary portion in the second direction, will contribute to securely position the exchangeable separation insert within the modular centrifugal separator when mounted therein.

According to embodiments, a third fluid passage may extend through the first stationary portion into the separation space, wherein the exchangeable separation insert comprising a third sealing member x, and wherein the third sealing member x at least partially seals the third fluid passage in a transition between the first stationary portion and the rotor casing. In this manner, at least part of the third fluid passage may be mechanically hermetically sealed between the rotor casing and the first stationary portion. For instance, if the third fluid passage forms part of an outlet from the separation space, the third sealing member may mechanically hermetically seal at least part of the outlet. According to some embodiments the first sealing member may mechanically hermetical seal a further part of the third fluid passage between the rotor casing and the first stationary portion.

Generally, a mechanical hermetical seal forms a completely different interface between rotating and stationary parts of the centrifugal separator than a hydraulic seal comprising e.g. a paring disc arranged inside a paring chamber, or a stationary disc submerged in a liquid inside the rotor casing. A mechanical hermetical seal includes an abutment between part of the rotatable rotor casing and a stationary portion. A hydraulic seal does not include an abutment between the rotating and stationary parts of a centrifugal separator.

Further features of, and advantages with, the invention will become apparent when studying the appended claims and the following detailed description.

BRIEF DESCRIPTION OF THE DRAWINGS

Various aspects and/or embodiments of the invention, including its particular features and advantages, will be readily understood from the example embodiments discussed in the following detailed description and the accompanying drawings, in which.

DETAILED DESCRIPTION

Aspects and/or embodiments of the invention will now be described more fully. Like numbers refer to like elements throughout. Well-known functions or constructions will not necessarily be described in detail for brevity and/or clarity.

Figure 1:
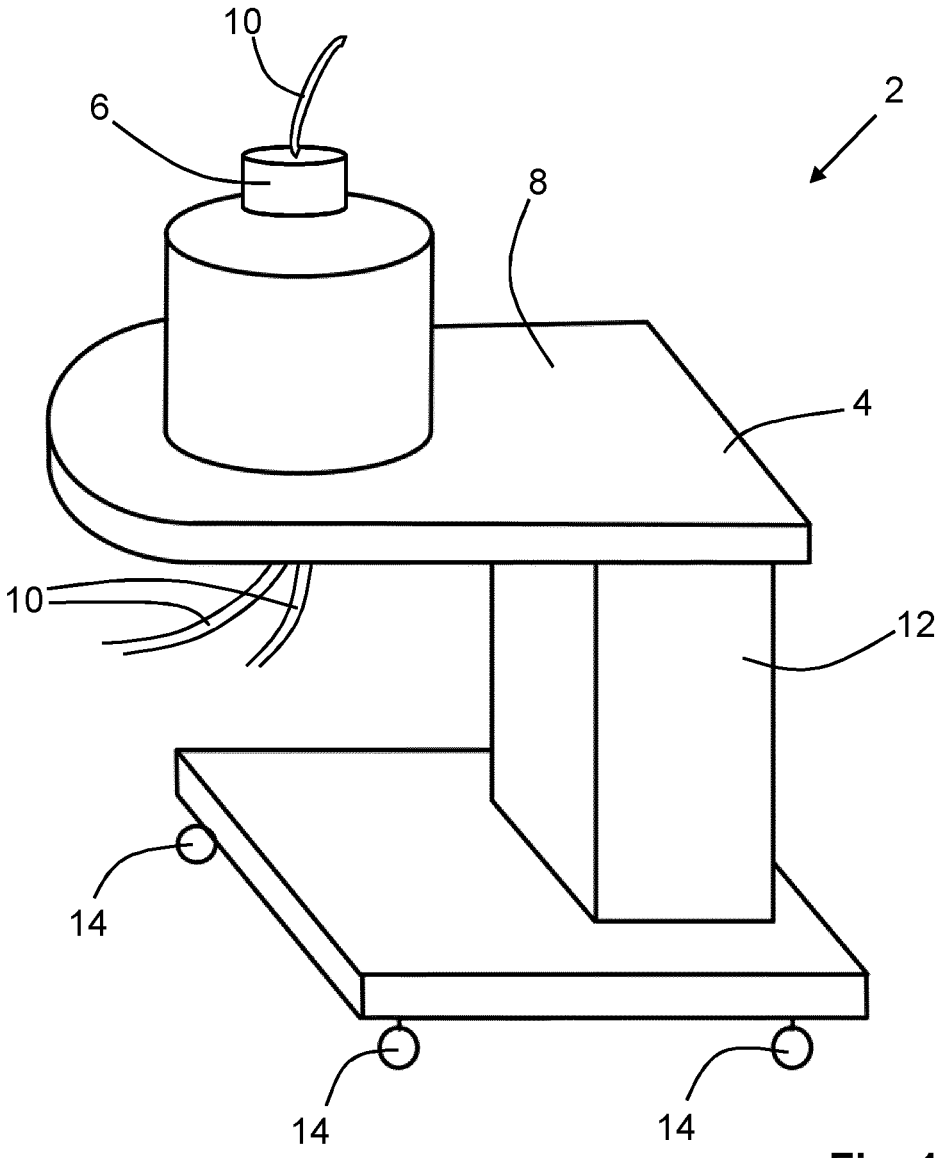
FIG. 1 schematically illustrates a modular centrifugal separator according to embodiments, FIG. 2 schematically illustrates a cross-section through an exchangeable separation insert according to embodiments, FIG. 3 schematically illustrates a cross section through a base unit for a modular centrifugal separator, and FIG. 4 schematically illustrates a cross section through a portion of a modular centrifugal separator.

FIG. 1 schematically illustrates a modular centrifugal separator 2 according to embodiments. The modular centrifugal separator 2 comprises a base unit 4 and an exchangeable separation insert 6. The modular centrifugal separator 2 may be configured for use in the field of pharmaceuticals, biopharmaceuticals, and/or biotechnology. The modular centrifugal separator 2 may form part of a set-up in a plant for the production of cells, such as CHO cells (Chinese Hamster Ovary cells) or other matter resulting from processes in the biotech industry, such as an expressed extracellular biomolecule.

The modular centrifugal separator 2 is configured for separating a liquid feed mixture into a heavy phase and a light phase. For instance, the liquid feed mixture may be formed by a fermentation broth including a cell culture, the heavy phase may comprise the cells separated from the main part of the fermentation broth. The light phase may be formed by main part the fermentation broth without the cells or with only a minimum rest amount of cells. The light phase may comprise an expressed extracellular biomolecule.

The modular centrifugal separator 2 is modular in the sense that it comprises the base unit 4 and the exchangeable separation insert 6. The exchangeable separation insert 6 is exchanged for each new batch of liquid feed mixture, which is to be separated. Alternatively, the exchangeable separation insert 6 may be exchanged for each new type of liquid feed mixture, which is to be separated, i.e. subsequent batches containing same type of liquid feed mixtures may be separated with the same exchangeable separation insert 6.

During use of the modular centrifugal separator 2, the liquid feed mixture, the heavy phase, and the light phase only come into contact with the exchangeable separation insert 6 of the modular centrifugal separator. Naturally, conduits in the form of tubes 10, configured for conducting the liquid feed mixture to the exchangeable separation insert 6 and for conducting the heavy phase and the light phase from the exchangeable separation insert 6, also come into contact with the liquid feed mixture and the heavy and light phases. The tubes 10 may form part of the exchangeable separation insert 6. The base unit 4 does not come into contact with the liquid feed mixture or any of the separated heavy and light phases.

The exchangeable separation insert 6 is further discussed below with reference to FIGS. 2 and 4.

The base unit 4 comprises components for supporting and rotating the exchangeable separation insert. Thus, the base unit 4 comprises inter alia a stationary frame 8, a rotatable member, and a drive unit for rotating the rotatable member. Accordingly, also the modular centrifugal separator 2 comprises a stationary frame 8, a rotatable member, and a drive unit for rotating the rotatable member. The stationary frame 8 comprises a vertical member 12. Part of the drive unit may be arranged in the vertical member 12.

The stationary frame 8 is stationary during use of the modular centrifugal separator. However, the base unit 4 as such may be movable, e.g. in order to be positioned at different locations at a production facility of the user. For this purpose, the stationary frame 8 may be provided with wheels 14.

The base unit 4 is further discussed below with reference to FIGS. 3 and 4.

Figure 2:
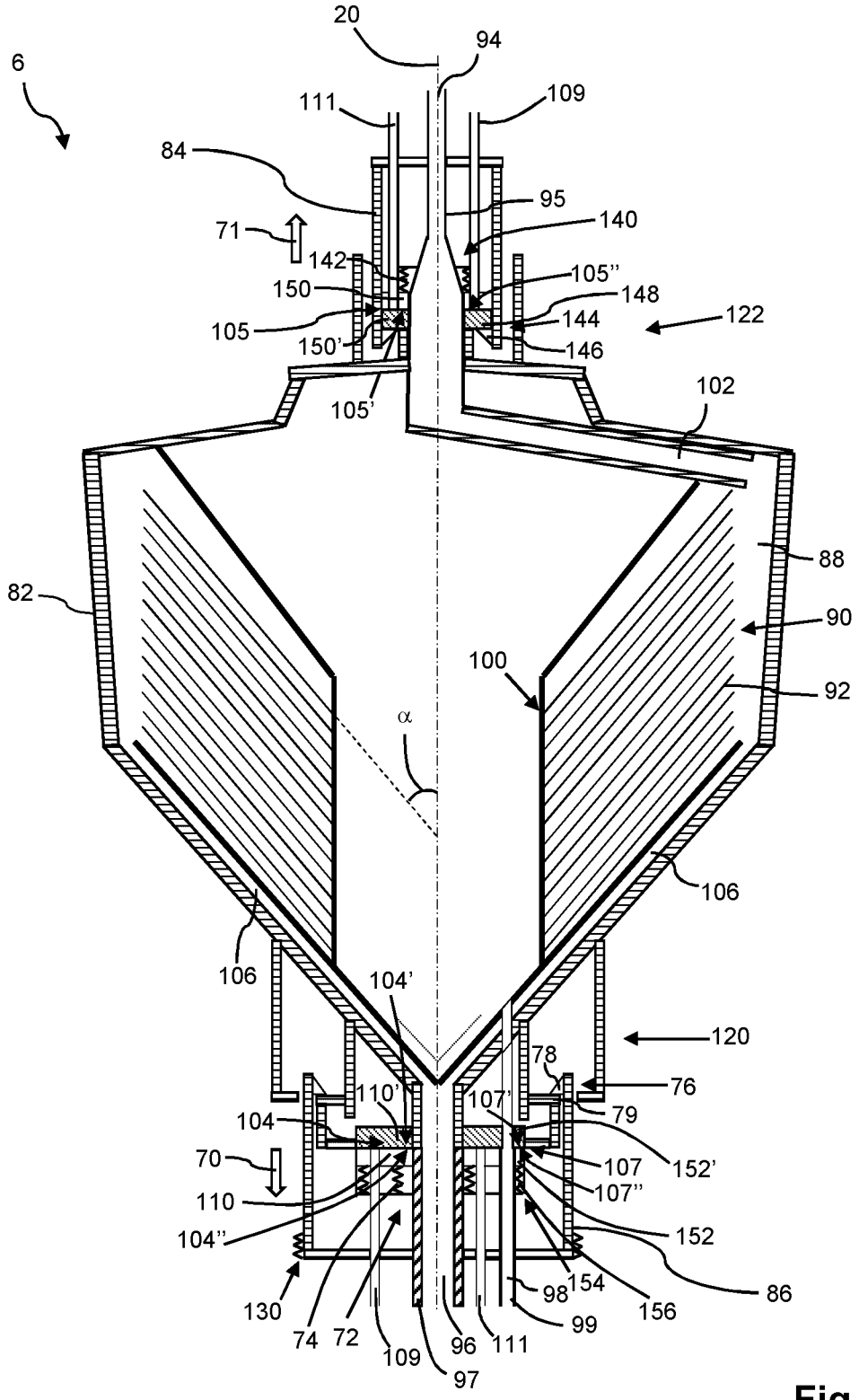

FIG. 2 schematically illustrates a cross-section through an exchangeable separation insert 6 according to embodiments. The exchangeable separation insert 6 is an exchangeable separation insert for a modular centrifugal separator, such as the modular centrifugal separator 2 discussed above in connection with FIG. 1 and below with reference to FIGS. 3 and 4. Accordingly, the exchangeable separation insert 6 may be configured for part of it to be arranged inside an inner space of a rotatable member as further discussed below in connection with FIGS. 3 and 4.

The exchangeable separation insert 6 comprises a rotor casing 82, a first stationary portion 86 and a second stationary portion 84. The rotor casing 82 is rotatable about an axis 20 of rotation. The axis 20 of rotation extends along an axial direction. The rotor casing 82 has a first axial end portion 120 and a second axial end portion 122. The rotor casing 82 is arranged between the first stationary portion 86 and the second stationary portion 84. The first stationary portion 86 is arranged at the first axial end portion 120. The second stationary portion 84 is arranged at the second axial end portion 122, In these embodiments, during operation of the modular centrifugal separator, the first stationary portion 86 is arranged at a lower axial end of the exchangeable separation insert 6, and the second stationary portion 84 is arranged at an upper axial end of the exchangeable separation insert 6.

The rotor casing 82 delimits a separation space 88 therein. The exchangeable separation insert 6 comprises a stack 90 of frustoconical separation discs 92 arranged in the separation space 88. The separation discs 92 in the stack 90 are arranged with an imaginary apex at the first stationary portion 86 or pointing towards the first stationary portion 86. The stack 90 may comprise at least 50 separation discs 92, such as at least 100 separation discs 92, such as at least 150 separation discs 92. Mentioned as an example, a separation disc 92 may have an outer diameter within a range of 160-400 mm, an inner diameter within a range of 60-100 mm, and an angle $\alpha$ between the axis 20 of rotation and an inner surface of the disc is 92 within a range of 35-40 degrees. For clarity reasons, only a few discs 92 are shown in FIG. 2.

A first fluid passage 96 extends through the first stationary portion 86 into the separation space 88. The exchangeable separation insert 6 comprises a first fluid connection 97 arranged at the first stationary portion 86. The first fluid connection 97 forms part of the first fluid passage 96. The first fluid connection 97 comprises one or more conduit portions.

A second fluid passage 94 extends through the second stationary portion 84 into the separation space 88. The exchangeable separation insert 6 comprises a second fluid connection 95 arranged at the second stationary portion 84. The second fluid connection 95 forms part of the second fluid passage 94. The second fluid connection 95 comprises one or more conduit portions.

In these embodiments, a third fluid passage 98 extends through the first stationary portion 86 into the separation space 88. The exchangeable separation insert 6 comprises a third fluid connection 99 arranged at the first stationary portion 86. The third fluid connection 99 forms part of the third fluid passage 98. The third fluid connection 99 comprises one or more conduit portions.

In these embodiments, the first fluid connection 97 is configured for conducting the liquid feed mixture to the separation space 88, the second fluid connection 95 is configured for conducting the heavy phase from the separation space 88, and the third fluid connection 99 is configured for conducting the light phase from the separation space 88. From the first fluid connection 97, the liquid feed mixture flows into the separation space 88 on the axis 20 of rotation. The liquid feed mixture is distributed from the axis 20 of rotation to an outer periphery of the separation space 88. The separated light phase flows towards the axis 20 of rotation and leaves the separation space 88 at a radial position between the axis 20 of rotation and the radially inner edges 100 of the separation discs 92 via the third fluid passage 98 and the third fluid connection 99.

The separated heavy phase flows towards the outer periphery of the separation space 88. From the outer periphery, the heavy phase is directed towards the axis 20 of rotation and flows out of the separation space 88 via the second fluid passage 94 and the second fluid connection 95. Namely, inside the rotor casing 82 there are arranged one or more outlet conduits 102 for the separated heavy phase from the separation space 88. The one or more outlet conduits 102 extend from a radially outer portion of the separation space 88 towards the axis 20 of rotation. The one or more outlet conduits 102 may each comprise a tube. Depending on the number of outlet conduits 102 and e.g. the density and/or viscosity of the heavy phase, each tube may have an inner diameter within a range of 2-10 mm. In this example, there is provided a single outlet conduit 102. Alternatively, there may be at least two such outlet conduits, such as at least three or such as at least five outlet conduits, evenly distributed over the circumference of the rotor casing 82. The outlet conduit 102 has a conduit inlet arranged at the radially outer portion and a conduit outlet at a radially inner portion. The outlet conduit 102 is arranged at an axially upper portion of the separation space 88.

Alternatively, the one or more outlet conduits may comprise a number of channels extending from the radially outer portion of the separation space towards the axis 20 of rotation. Whereas an outlet conduit 102 comprising a tube has the same cross-sectional area along its extension, such channels may have a larger cross-sectional area at their radially outer portion than towards the axis 20 of rotation.

The first stationary portion 86 is biased in a first direction 70 away from the rotor casing along the axial direction. The first direction 70 is indicated with an arrow in FIG. 2. Biasing of the first stationary portion 86 in the first direction at 70 may be achieved in a number of different ways, e.g. utilising compression or extension springs.

The bias of the first stationary portion 86 in the first direction 70, will contribute to securely position the exchangeable separation insert 6 within the base unit of the modular centrifugal separator, see further below with reference to FIG. 4.

The first stationary portion 86 comprises a first set of springs 72. The first set of springs 72 comprises at least one spring element 74. In these embodiments, the at least one spring element 74 is a helical compression spring. The at least one spring element 74 of the first set of springs 72 is arranged in the first stationary portion 86 such that when energy is stored in the at least one spring element 74 of the first set of springs 72, the first stationary portion 86 is biased in the first direction 70 away from the rotor casing 82 along the axial direction.

The exchangeable separation insert 6 comprises a first stop mechanism 76 configured for preventing the first stationary portion 86 from being biased in the first direction 70 away from the rotor casing 82 along the axial direction beyond a first distal end position. Thus, the first stop mechanism 76 prevents the first stationary portion 86 from being separated from the rotor casing 82. The energy stored in the at least one spring element 74 of the first set of springs 72 biases the first stationary portion 86 into the first distal end position.

In FIG. 2 the first stationary portion 86 is shown in the first distal end position. That is, when the exchangeable separation insert 6 is separate from the base unit of the modular centrifugal separator, due to the bias provided by the first set of springs 72, the first stationary portion 86 is positioned in the first distal end position in relation to the rotor casing 82. On the other hand, when the exchangeable separation insert 6 is mounted in the base unit of the modular centrifugal separator, the first stationary portion 86 has been displaced from the first distal end position into a first proximal position, against the bias provided by the first set of springs 72.

In these embodiments, the first stop mechanism 76 comprises a first protrusion 78 fixed in relation to the first stationary portion 86 and extending in a radial direction, and a second protrusion 79 fixed in relation to the rotor casing 82 and extending in a radial direction, and wherein the first and second protrusions 78, 79 are configured to abut against each other when the first stationary portion 86 is in the first distal end position. In this manner, the first distal end position may be provided for the first stationary portion 86. The radial direction is radial seen in relation to the axial direction.

As mentioned above, the first fluid passage 96 forms part of an inlet for the liquid feed mixture. That is, the first fluid connection 97 forms an inlet for the liquid feed mixture. A first sealing member 104 forms a seal between a stationary and a rotatable part of the inlet.

The exchangeable separation insert 6 comprises the first sealing member 104. The first sealing member 104 seals the first fluid passage 96 in a transition between the first stationary portion 86 and the rotor casing 82. The first sealing member 104 forms a mechanical hermetical seal of the first fluid passage 96. The first sealing member 104 extends circumferentially around the first fluid passage 96, thus, sealing the first fluid passage 96.

The first sealing member 104 comprises a first stationary sealing element 110 provided with a first stationary sealing surface 104' arranged in the first stationary portion 86 and a first rotatable sealing element 110' provided with a first opposite sealing surface 104" arranged in the rotor casing 82. The first stationary sealing surface 104' abuts against the first opposite sealing surface 104". Thus, a mechanical hermetical seal is provided at an interface between the first stationary sealing surface 104' and the first opposite sealing surface 104". When the rotor casing 82 rotates during use of the modular centrifugal separator, the first opposite sealing surface 104" rotates with the rotor casing 82.

The first stationary portion 86 is axially displaceable in relation to the first stationary sealing element 110. The at least one spring element 74 of the first set of springs 72 is arranged between the first stationary portion 86 and the first stationary sealing element 110 such that when energy is stored in the at least one spring element 74 of the first set of springs 72, the first stationary portion 86 is biased in the first direction 70 away from the rotor casing 82 along the axial direction. Moreover, the first stationary sealing element 110 is pressed against the first rotatable sealing element 110' by the energy stored in the at least one spring element 74. That is, when the first stationary portion 86 is displaced between its first distal end position and first proximal position, the first stationary sealing element 110 remains in one position, with its first stationary sealing surface 104' abutting against the first opposite sealing surface 104" of the rotatable sealing element 110'.

In this manner, the bias of the first stationary portion 86 in the first direction 70 is achieved in these embodiments. Also, a sealing abutment between the first stationary sealing surface 104' and the first opposite sealing surface 104" is achieved in this manner. The sealing abutment is thus, provided when the first stationary portion 86 is in its first proximal position. Similarly, in the first distal end position, the sealing abutment may be achieved under the condition that the first stationary portion 86 is biased in the first direction away from the rotor casing 82 also in the first distal end position. Thus, a sealing abutment between the first stationary sealing element 110 and the first rotatable sealing element 110' may be achieved also when the exchangeable separation insert 6 is separate from the base unit of the modular centrifugal separator.

Accordingly, sealing abutment between the first stationary sealing surface 104' and the first opposite sealing surface 104" may be achieved in the first proximal end position of the first stationary portion 86 as well as in the first distal end position of the first stationary portion 86.

In a similar manner to the first stationary portion 86, also the second stationary portion 84 is biased in a direction 71 away from the rotor casing 82 along the axial direction. The second stationary portion 84 is biased in a second direction 71 away from the rotor casing 82. The second direction 71 is indicated with an arrow in FIG. 2 and is directed in an opposite direction to the first direction 70.

As with the first stationary portion 86, since the second stationary portion 84 is biased in a direction 71 away from the rotor casing 82, the exchangeable separation insert 6 is configured for being compressed by positioning the second stationary portion 84 towards the rotor casing 82, i.e. against the bias in the second direction 71. The bias in the second direction 71 may contribute to positioning the exchangeable separation insert 6 in the base unit of the modular centrifugal separator.

The second stationary portion 84 comprises a second set of springs 140. The second set of springs 140 comprises at least one spring element 142. The at least one spring element 142 of the second set of springs 140 is arranged in the second stationary portion 84 such that when energy is stored in the at least one spring element 142 of the second set of springs 140, the second stationary portion 84 is biased in the second direction 71 away from the rotor casing 82 along the axial direction. In this manner, the bias of the second stationary portion 84 in the second direction 71 is achieved.

The exchangeable separation insert 6 comprises a second stop mechanism 144 for preventing the second stationary portion 84 from being biased in the second direction 71 away from the rotor casing 82 along the axial direction beyond a second distal end position. Thus, the second stop mechanism 144 prevents the second stationary portion 84 from being separated from the rotor casing 82. The energy stored in the at least one spring element 142 of the second set of springs 140 biases the second stationary portion 84 into the second distal end position.

In FIG. 2 the second stationary portion 84 is shown in the second distal end position. That is, when the exchangeable separation insert 6 is separate from the base unit of the modular centrifugal separator, due to the bias provided by the second set of springs 140, the second stationary portion 84 is positioned in the second distal end position in relation to the rotor casing 82. On the other hand, when the exchangeable separation insert 6 is mounted in the base unit of the modular centrifugal separator, the second stationary portion 84 has been displaced from the second distal end position into a second proximal position, against the bias provided by the second set of springs 140.

In these embodiments, the second stop mechanism 144 comprises a third protrusion 146 fixed in relation to the second stationary portion 84 and extending in a radial direction, and a fourth protrusion 148 fixed in relation to the rotor casing 82 and extending in a radial direction, and wherein the third and fourth protrusions 146, 148 are configured to abut against each other when the second stationary portion 84 is in the second distal end position. In this manner, the second distal end position may be provided for the second stationary portion 84. Again, the radial direction is radial seen in relation to the axial direction.

As mentioned above, the second fluid passage 94 forms part of an outlet for the separated heavy phase. That is, the second fluid connection 95 forms an outlet for the heavy phase from the separation space 88. A second sealing member 105 forms a seal between a stationary and a rotatable part of the outlet for heavy phase.

The exchangeable separation insert 6 comprises a second sealing member 105. The second sealing member 105 seals the second fluid passage 94 in a transition between the second stationary portion 84 and the rotor casing 82. The second sealing member 105 forms a mechanical hermetical seal of the second fluid passage 94. The second sealing member 105 extends circumferentially around the second fluid passage 94, thus, sealing the second fluid passage 94.

The second sealing member 105 comprises a second stationary element 150 provided with a second stationary sealing surface 105' arranged in the second stationary portion 84 and a second rotatable sealing element 150' provided with a second opposite sealing surface 105" arranged at the rotor casing 82. The second stationary sealing surface 105' abuts against the second opposite sealing surface 105". Thus, a mechanical hermetical seal is provided at an interface between the second stationary sealing surface 105' and the second opposite sealing surface 105". When the rotor casing 82 rotates during use of the modular centrifugal separator, the first opposite sealing surface 105" rotates with the rotor casing 82.

The second stationary portion 84 is axially displaceable in relation to the second stationary sealing element 150. The at least one spring element 142 of the second set of springs 140 is arranged between the second stationary portion 84 and the second stationary sealing element 150 such that when energy is stored in the at least one spring element 142 of the second set of springs 140, the second stationary portion 84 is biased in the second direction 71 away from the rotor casing 82 along the axial direction and the second stationary sealing element 150 is pressed against the second rotatable sealing element 150'. In this manner, sealing abutment between the second stationary sealing element 150 and the second rotatable sealing element 150' is achieved. The sealing abutment between the second stationary sealing surface 105' and the second opposite sealing surface 105" ensures a mechanical hermetical seal of the second fluid passage 94. Also, in this manner, the bias of the second stationary portion 84 in the second direction 71 away from the rotor casing 82 is achieved, which may contribute to positioning the exchangeable separation insert 6 within the base unit of the modular centrifugal separator.

When the second stationary portion 84 is displaced between its second distal end position and second proximal position, the second stationary sealing element 150 remains in one position, with its second stationary sealing surface 105' abutting against the second opposite sealing surface 105" of the rotatable sealing element 150'.

A sealing abutment between the second stationary sealing surface 105' and the second opposite sealing surface 105" is achieved. The sealing abutment is thus, provided when the second stationary portion 84 is in its second proximal position. Similarly, in the second distal end position, the sealing abutment may be achieved under the condition that the second stationary portion 84 is biased in the first direction away from the rotor casing 82 also in the second distal end position. Thus, a sealing abutment between the second stationary sealing element 150 and the second rotatable sealing element 150' may be achieved also when the exchangeable separation insert 6 is separate from the base unit of the modular centrifugal separator.

Accordingly, sealing abutment between the second stationary sealing surface 105' and the second opposite sealing surface 105" may be achieved in the second proximal end position of the second stationary portion 84 as well as in the second distal end position of the second stationary portion 84.

The exchangeable separation insert 6 comprises a third sealing member 107. The third sealing member 107 at least partially seals the third fluid passage 98 in a transition between the first stationary portion 86 and the rotor casing 82. The third sealing member 107 forms a mechanical hermetical seal of the third fluid passage 98.

The third sealing member 107 extends circumferentially around the first sealing member 104. The third fluid passage 98 passes from the rotor casing 82 to the first stationary portion 86 between the first and third sealing members 104, 107. Accordingly, the first sealing member 104 may seal a further part of the third fluid passage 98 between the rotor casing 82 and the first stationary portion 86.

The third sealing member 107 comprises a third stationary sealing element 152 provided with a third stationary sealing surface 107' arranged in the first stationary portion 86 and a third rotatable sealing element 152' provided with a third opposite sealing surface 107" arranged in the rotor casing 82. The third stationary sealing surface 107' abuts against the third opposite sealing surface 107". Thus, a mechanical hermetical seal is provided at an interface between the third stationary sealing surface 107' and the third opposite sealing surface 107". When the rotor casing 82 rotates during use of the modular centrifugal separator, the third opposite sealing surface 107" rotates with the rotor casing 82.

In the illustrated embodiments, the first stationary portion 86 comprises a third set of springs 154. The third set of springs 154 comprises at least one spring element 156. The at least one spring element 156 of the third set of springs 154 is arranged in the first stationary portion 86 such that when energy is stored in the at least one spring element 156 of the third set of springs 154, the first stationary portion 86 is biased in the first direction 70 away from the rotor casing 82 along the axial direction. In this manner, the energy stored in the at least one spring element 156 of the third set of springs 154 may contribute to the bias of the first stationary portion 86 in the first direction 70 away from the rotor casing 82.

The first stationary portion 86 is axially displaceable in relation to the third stationary sealing element 152. The at least one spring element 156 of the third set of springs 154 is arranged between the first stationary portion 86 and the third stationary sealing element 152 such that when energy is stored in the at least one spring element 156 of the third set of springs 154, the first stationary portion 86 is biased in the first direction 70 away from the rotor casing 82 along the axial direction and the third stationary sealing element 152 is pressed against the third rotatable sealing element 152'. In this manner, sealing abutment between the third stationary sealing element 152 and the third rotatable sealing element 152' may be achieved. More specifically, in this manner sealing abutment between the third stationary sealing surface 107' and the third opposite sealing surface 107" may be ensured in order to provide a mechanical hermetical seal of at least part of the third fluid passage 98.

The sealing abutment between the third stationary sealing surface 107' and the third opposite sealing surface 107" is provided when the first stationary portion 86 is in its first proximal position. Similarly, in the first distal end position, the sealing abutment may be achieved under the condition that the third set of springs contributes to biasing the first stationary portion 86 in the first direction away from the rotor casing 82 also in the first distal end position. Thus, a sealing abutment between the third stationary sealing element 152 and the third rotatable sealing element 152' may be achieved also when the exchangeable separation insert 6 is separate from the base unit of the modular centrifugal separator.

Accordingly, sealing abutment between the third stationary sealing surface 107' and the third opposite sealing surface 107" may be achieved in the first proximal end position of the first stationary portion 86 as well as in the first distal end position of the first stationary portion 86.

According to some embodiments, the first and third sealing members 104, 107 may be at least partly integrated with each other. For instance, the first and third rotatable sealing elements 110', 152' may be provided in the same component, and/or the first and third stationary sealing elements 110, 152 may be provided in the same component. If the first and third stationary sealing elements 110, 152 are provided in the same component it may be an option to omit the third set of springs 154.

The sealing members 104, 105, 107 may be provided with fluid inlets 109 and fluid outlets 111 for supplying and withdrawing a fluid, such as a cooling liquid. Thus, the sealing members 104, 105, 107 may be cooled. In FIG. 2, one fluid inlet 109 and one fluid outlet 111 is shown at the sealing members 104, 105, 107. However, further fluid inlets and outlets may be provided at the sealing members 104, 105, 107.

The first, second, and third fluid connections 97, 95, 99 may comprise tubing, such as plastic tubing.

During operation, the exchangeable separation insert 6, arranged in a rotatable member, is brought into rotation around the axis 20 of rotation. Liquid feed mixture to be separated is supplied via the first fluid connection 97 arranged in the first stationary portion 86 and guiding channels 106 into the separation space 88. The liquid feed mixture to be separated is guided along an axially upwardly path into the separation space 88. Due to a density difference the liquid feed mixture is separated into a liquid light phase and a liquid heavy phase. This separation is facilitated by the interspaces between the separation discs 92 of the stack 90 fitted in the separation space 88. The heavy phase may comprise particles, such as e.g. cells. The heavy phase may comprise a concentrated mixture of light phase and particles.

The separated heavy phase is collected from the periphery of the separation space 88 via outlet conduit 102 and is led out of the rotor casing 82 to the second fluid connection 95 arranged in the second stationary portion 84. Separated light phase is forced radially inwardly through the stack 90 of separation discs 92 and led out of the rotor casing 82 to the third fluid connection 98 arranged in the first stationary portion 86. Consequently, in this embodiment, the liquid feed mixture is supplied at a lower axial end of the exchangeable separation insert 6, the separated light phase is discharged at the lower axial end, and the separated heavy phase is discharged at the upper axial end of the exchangeable separation insert 6.

The first stationary portion 86 comprises an outer threaded portion 130. The outer threaded portion 130 is configured to engage with a correspondingly inner threaded portion. The inner threaded portion may be provided as part of an engagement member provided at the stationary frame of the modular centrifugal separator. Thus, the first stationary portion 86 may be fixed in relation to the stationary frame, see further below with reference to FIG. 4.

Figure 3:
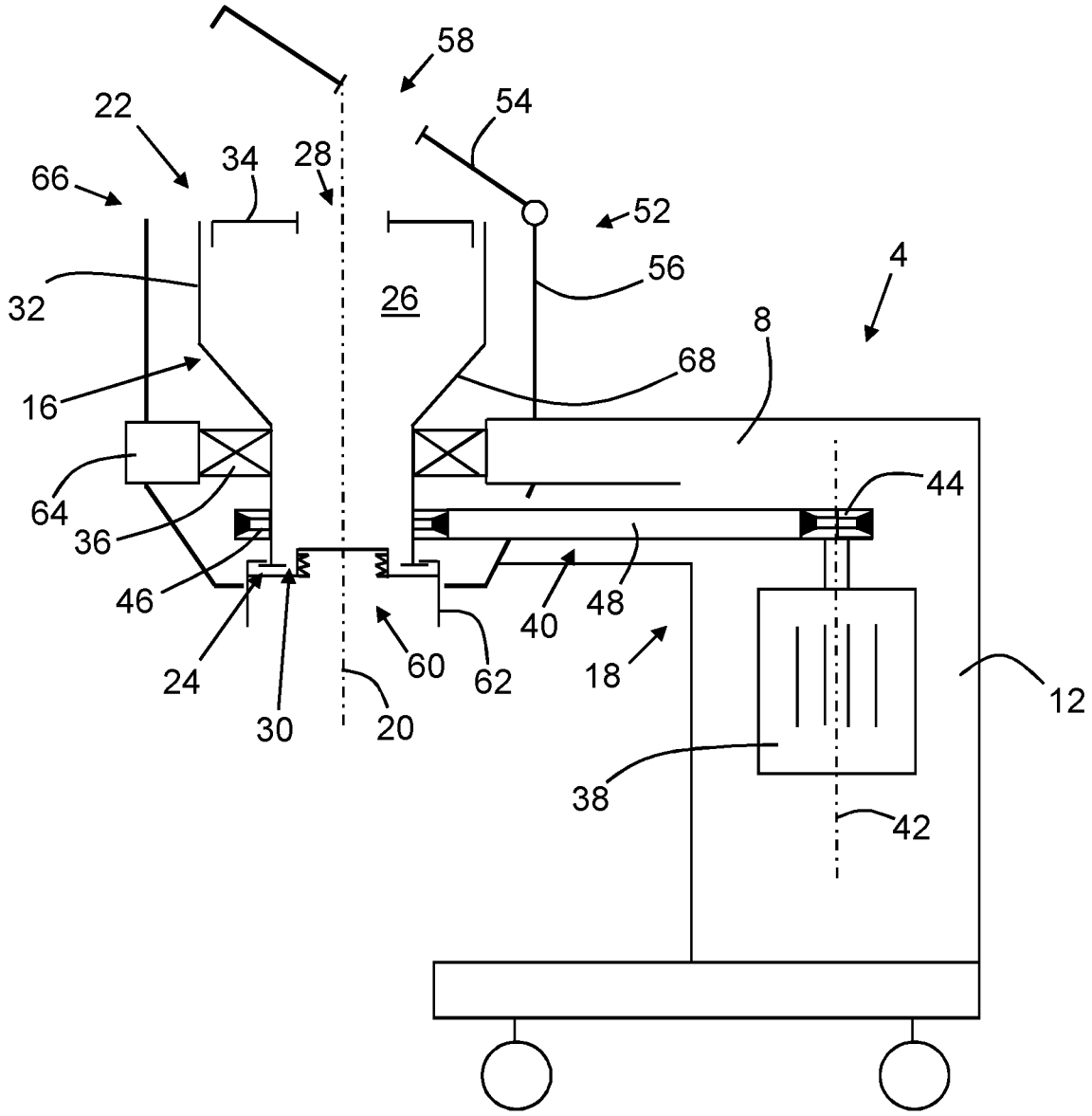

FIG. 3 schematically illustrates a cross section through the base unit 4 of the modular centrifugal separator 2 of FIG. 1. That is, in FIG. 3 the exchangeable separation insert has been omitted.

As mentioned above, the base unit 4 comprises the stationary frame 8, the rotatable member 16, and the drive unit 18. The rotatable member 16 is arranged in the stationary frame 8 and is configured to rotate about an axis 20 of rotation. The drive unit 18 is configured for rotating the rotatable member 16 about the axis 20 of rotation.

Seen along the axis 20 of rotation, the rotatable member 16 has a first axial end 24 and a second axial end 22. The rotatable member 16 delimits an inner space 26 at least in a radial direction. The radial direction extends perpendicularly to the axis 20 of rotation. The inner space 26 is configured for receiving at least one part of the exchangeable separation insert therein, see further below with reference to FIG. 4.

The rotatable member 16 is provided with a first opening 30 at the first axial end 24. The rotatable member 16 further is provided with a second opening 28 at the second axial end 22. Each of the first and second openings 30, 28 forms a through hole in the rotatable member 16. Thus, the inner space 26 is accessible via each of the first and second openings 30, 28. Accordingly, the first and second openings 30, 28 are configured for fluid connections of the exchangeable separation insert to extend therethrough. See further below with reference to FIG. 4.

In these embodiments, the rotatable member 16 comprises a rotor body 32 and a cap 34. The cap 34 is releasably engaged with the rotor body 32. The cap 34 may for instance be releasably engaged with the rotor body 32 by means of threads, a bayonet coupling, screws, wingnuts, or any other suitable engagement arrangement. When the cap 34 is released from the rotor body 32, access to the inner space 26 is provided. When access to the inner space 26 is provided, an exchangeable separation insert may be mounted in the inner space 26. Similarly, when access to the inner space 26 is provided, an exchangeable separation insert may be removed from the inner space 26. Thus, a used exchangeable separation insert may be replaced with a new exchangeable separation insert when the cap 34 has been released from the rotor body 32.

The cap 34 may be arranged in a region of the second axial end 22 of the rotor body 32. Accordingly, the second opening 28 of the rotatable member 16 is arranged in the cap 34. As mentioned above, a fluid connection of the exchangeable separation insert may extend through the second opening 28.

The base unit 4 comprises at least one bearing 36. The rotatable member 16 is journalled in the stationary frame 8 via the at least one bearing 36. Accordingly, the rotatable member 16 as such is journalled in the stationary frame 8. Also, the rotatable member 16 may be supported in the stationary frame 8 via the at least one bearing 36. Accordingly, the rotatable member 16 is not indirect journalled via a spindle or shaft as in prior art centrifugal separators comprising an exchangeable separation insert.

The at least one bearing 36 may be for instance one single ball bearing which supports both radial and axial forces. Alternatively, the at least one bearing 36 may comprise e.g. two bearings, for instance one which primarily supports radial forces and one which primarily supports axial forces.

The at least one bearing 36 is arranged at an axial position along the axis 20 of rotation such that the at least one bearing 36 extends around a portion of the inner space 26 delimited by the rotatable member 16. Since during use of the modular centrifugal separator the exchangeable separation insert is arranged in the inner space 26, the rotatable member 16 is supported in an axial position where the exchangeable separation insert also is positioned. Thus, the at least one bearing 36 provides reliable support of the rotatable member 16.

The drive unit 18 comprises an electric motor 38, and a transmission 40 arranged between the electric motor 38 and the rotatable member 16. The transmission 40 provides for the electric motor 38 to be arranged axially beside the rotatable member 16. That is, an axis 42 of rotation of the electric motor 38 extends substantially in parallel with the axis 20 of rotation of the rotatable member 16. Since the electric motor 38 is arranged axially beside the rotatable member 16, access inter alia to both the first and second axial ends 24, 22 of the rotatable member 16 may be provided. That is, access to neither of the first and second axial ends 24, 22 is blocked by the electric motor 38.

In the shown embodiments, the transmission 40 is a belt drive comprising a first pulley 44 arranged on the electric motor 38, a second pulley 46 arranged on the rotatable member 16, and a belt 48 extending between the first and second pullies 44, 46. Alternatively, the transmission may be a gear transmission comprising cog wheels, or any other suitable transmission for transferring torque from the electric motor 38 to the rotatable member 16.

In the shown embodiments, the stationary frame 8 comprises a vertical member 12. The electric motor 38 is arranged at least partially inside the vertical member 12. In this manner, the electric motor at 38 is protectively arranged within the stationary frame 8. A user of the modular centrifugal separator will not risk coming into contact with rotating parts of, or at, the electric motor 38. Similarly, the belt 48 may be arranged at least partly inside the stationary frame 8 in order to prevent a user of the modular centrifugal separator from coming into contact therewith.

The stationary frame 8 comprises a housing 52. The rotatable member 16 is arranged inside the housing 52. The housing 52 comprises a lid 54, which is pivotably or removably connected to a first housing portion 56 of the housing 52. The lid 54 is provided with a third opening 58. The third opening 58 forms a through hole in the lid 54.

In an open position of the lid 54, access is provided to the rotatable member 16 inside the housing 52, e.g. for exchange of the exchangeable separation insert. Thus, in order to remove and/or position an exchangeable separation insert inside the rotatable member 16, the lid 54 is moved to its open position and the cap 34 of the rotatable member 16 is released from the rotor body 32. Once the exchangeable separation insert has been positioned inside the inner space 26 of the rotatable member 16 the cap 34 is again engaged with the rotor body 32. Thereafter the lid 54 is moved to a closed position.

In the closed position of the lid 54 the third opening 58 is configured for a fluid connection of the exchangeable separation insert to extend therethrough. During use of the modular centrifugal separator the lid 54 is arranged in its closed position. Thus, the rotatable member 16 cannot be accessed by a user of the modular centrifugal separator. The third opening 58 provides for one of the fluid connections of the exchangeable separation insert to extend therethrough and permit fluid to pass to, and/or pass from, the exchangeable separation insert at the second axial end 22 of the rotatable member 16.

A fourth opening 60 may be provided opposite to the lid 54. The fourth opening 60 is configured for a further fluid connection of the exchangeable separation insert to extend therethrough. Thus, the further fluid connection may extend from the housing 52 at the first axial end 24 of the rotatable member 16.

The fourth opening 60 may be provided in the housing 52, and/or in the stationary frame 8, and/or in an engagement member 62 arranged at the first axial end 24. In any case, the fourth opening 60 forms a through hole thus, permitting the further fluid connection of the exchangeable separation insert to extend therethrough.

In these embodiments, the base unit 4 comprises an engagement member 62. The engagement member 62 is arranged at the fourth opening 60. The engagement member 62 is configured to engage with a portion of the exchangeable separation insert, see further below with reference to FIG. 4.

The stationary frame 8 comprises a protruding member 64. The housing 52 is connected to the protruding member 64. Thus, access is provided to the housing 52 and also to the rotatable member 16 arranged in the housing 52. The housing 52 is connected to the protruding member 64 such that access is provided at least to one end 66 of the housing 52 along the axis 20 of rotation. Suitably, the housing 52 is connected to the protruding member 64 in a manner such that access is provided to that end of the housing 52 where the lid 54 is arranged. Thus, a user may access an inside of the housing 52, e.g. for exchanging the exchangeable separation insert in the rotatable member 16. Moreover, if access is provided at opposite ends of the housing 52 along the axis 20 of rotation, the user will be able to install the first and second fluid connections of the exchangeable separation insert through the first, second, third, and fourth openings 28, 30, 58, 60.

The rotatable member 16 is journalled inside the housing 52 of the stationary frame 8. That is, the bearing 36 in which the rotatable member 16 is journalled is arranged within the housing 52. The housing 52 may be suspended in the protruding member 64 via at least one resilient connector (not shown) to reduce negative effects on the modular centrifugal separator when the rotatable member 16 together with the rotor casing of the exchangeable separation insert passes the critical speed during operation of the modular centrifugal separator.

The rotatable member 16 comprises a frustoconical wall member 68 having an imaginary apex in a region of the first axial end 24. The frustoconical wall member 68 delimits a portion of the inner space 26. When positioned in the inner space 26, an exchangeable separation insert having a conical or frustoconical shape is supported by the frustoconical wall member 68. The frustoconical wall member 68 forms part of the rotor body 32.

Figure 4:
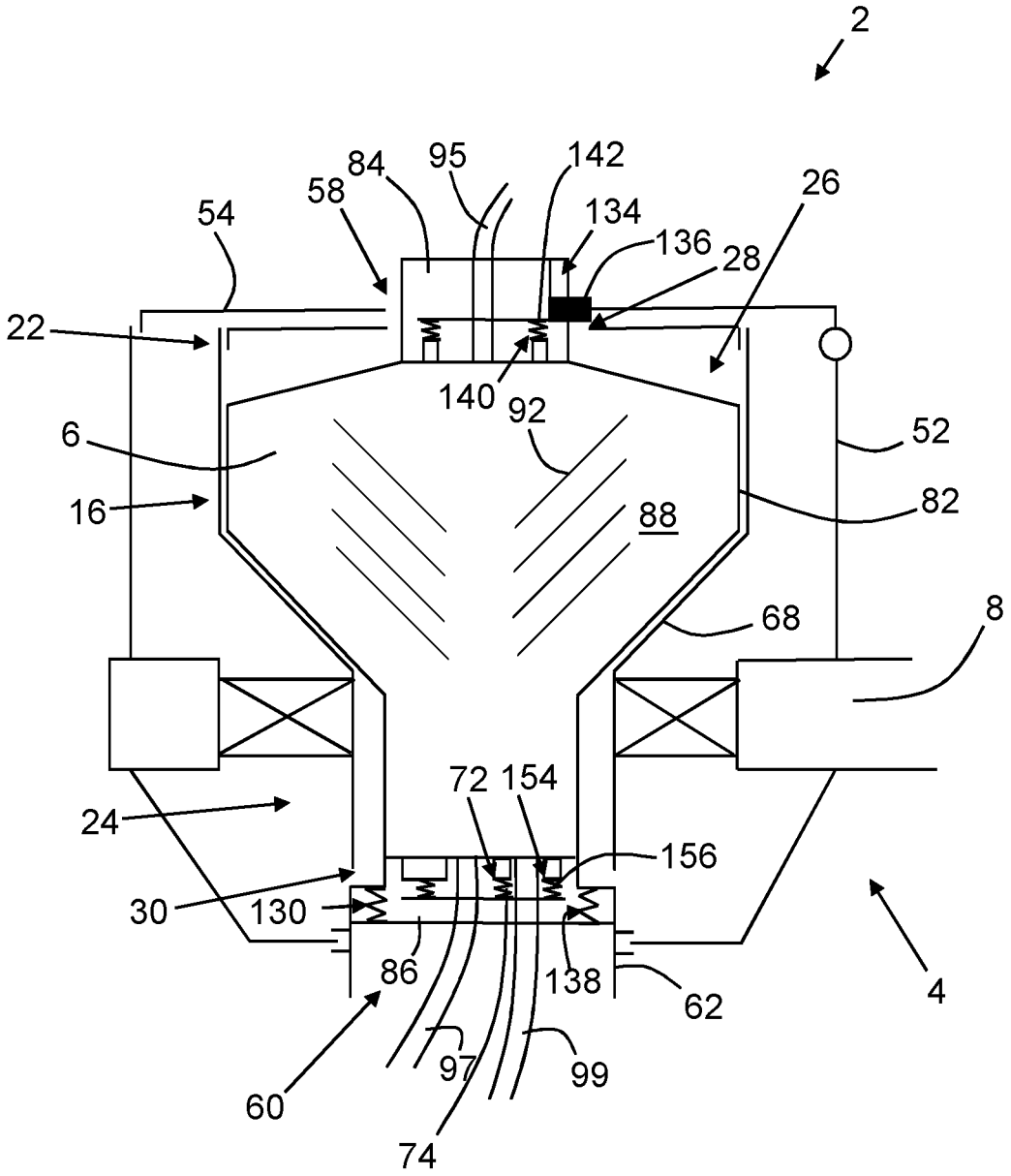

FIG. 4 schematically illustrates a cross section through a portion of a modular centrifugal separator 2. More specifically, FIG. 4 shows a cross section through a housing 52, a rotatable member 16, and an exchangeable separation insert 6 of the modular centrifugal separator 2. The modular centrifugal separator 2 may be a modular centrifugal separator 2 as discussed above in connection with FIGS. 1-3. The exchangeable separation insert 6 may be an exchangeable separation insert 6 as discussed above in connection with FIG. 2. Accordingly, in the following, reference is also made to FIGS. 1-3.

In FIG. 4 the exchangeable separation insert 6 is shown mounted in the base unit 4. Part of the exchangeable separation insert 6 is engaged inside the rotatable member 16. More specifically, the rotor casing 82 of the exchangeable separation insert 6 is engaged in the inner space 26 of the rotatable member 16 with the second fluid connection 95 of the exchangeable separation insert 6 extending through the second opening 28 of the rotatable member 16 and the first fluid connection 97 of the exchangeable separation insert 6 extending through the first opening 30 of the rotatable member 16. In these embodiments, also the third fluid connection 99 extends through the first opening 30.

The rotor casing 82 of the exchangeable separation insert 6 is releasably engaged inside the rotatable member 16. The rotor casing 82 may be engaged inside the rotatable member 16 in a number of different ways. For instance, the cap 34 when engaged with the rotor body 32, may engage the rotor casing 82, an inside of the rotatable member 16 may be provided with protrusions and the rotor casing 82 may be provided with corresponding recesses, etc.

The first stationary portion 86 is releasably engaged with the stationary frame 8.

In these embodiments, and as mentioned above in connection with FIG. 3, an engagement member 62 is arranged at the fourth opening 60. More specifically, the fourth opening 60 extends through the engagement member 62. The engagement member 62 is configured to engage with a portion of the exchangeable separation insert 6. More specifically, the engagement member 62 is configured to engage with the first stationary portion 86 of the exchangeable separation insert 6. When engaged with the first stationary portion 86, the engagement member 62 and the first stationary portion 86 are fixed in relation to the stationary frame 8, i.e. the first stationary portion 86 is fixedly engaged with the stationary frame 8.

In these embodiments, the engagement member 62 comprises an inner threaded portion 138 and the first stationary portion 86 comprises the outer threaded portion 130, as discussed above with reference to FIG. 2. Thus, the engagement member 62 is threadedly engaged with the first stationary portion 86. According to alternative embodiments, e.g. a bayonet coupling may be provided between the engagement member 62 and the first stationary portion 86.

When the first stationary portion 86 is engaged with the frame 8, the first stationary portion 86 is arranged in a first proximal position along the axial direction, counter to the bias in the first direction 70, such that securing of the exchangeable separation insert 6 in the base unit 4 is contributed to. The first proximal position is closer to the rotor casing 82 than the first distal end position of the first stationary portion 86 provided in an unmounted state of the exchangeable separation insert 6 and as shown in FIG. 2.

Thus, the exchangeable separation insert 6 is compressed by positioning the first stationary portion 86, against the bias, towards the rotor casing 82 in the first proximal position counter to the bias in the first direction 70. The bias of the first stationary portion 86 in the first direction 70, contributes to securely position the first stationary portion 86 in the stationary frame 8.

Schematically, in FIG. 4 it is shown how the at least one spring element 74 of the first set of springs 72 has been compressed when the first stationary portion 86 is arranged in the first proximal position.

Part of the first stationary portion 86 extends through the first opening 30. Thus, at the first axial end 24 of the rotatable member 16, at least part of the first stationary portion 86 is arranged outside the rotatable member 16. Accordingly, the first stationary portion 86 may be engaged with the stationary frame 8 to ensure that the first stationary portion 86 remains stationary during operation of the modular centrifugal separator 2.

Part of the second stationary portion 84 extends through the second opening 28. Thus, at the second axial end 22 of the rotor casing 82, at least part of the second stationary portion 84 is arranged outside the rotatable member 16. Accordingly, the second stationary portion 84 may be engaged with the stationary frame 8 to ensure that the second stationary portion 84 remains stationary during operation of the modular centrifugal separator 2.

The first and second openings 30, 28 at opposite axial ends 24, 22 of the rotatable member 16 provide for easy mounting of the exchangeable separation insert 6 in the rotatable member 16 with the first and second fluid connections 96, 94 extending through respective of the first and second openings 30, 28.

Thus, the first fluid connection 97 extending through the first opening 30 may extend to equipment external of the modular centrifugal separator 2. Similarly, the second fluid connection 95 extending through the second opening 28 may extend to equipment external of the modular centrifugal separator 2. Accordingly, the first and second fluid connections 97, 95 may be connected to such external equipment.

The fluid connections 95, 97, 99 of the exchangeable separation insert 6 extend out of the housing 52. The second fluid connection 95 extends through the third opening 58 of the housing 52. Also, at least part of the second stationary portion 84 extends through the third opening 58. The first fluid connection 97 extends through a fourth opening 60. As mentioned above, the fourth opening 60 may be provided in the housing 52, or alternatively, in a different portion of the stationary frame 8 of the modular centrifugal separator 2. In these embodiments, also the third fluid connection 99 extends through the fourth opening 60.

As mentioned above in connection with FIG. 3, the third opening 58 may be provided in a lid 54 of the housing 52. The lid 54 is configured to engage with a portion of the exchangeable separation insert 6. More specifically, the lid 54 is configured to engage with the second stationary portion 84. Thus, the second stationary portion 84 is releasably engaged with the stationary frame 8. Accordingly, the second stationary portion 84 is maintained in a predefined position during use of the modular centrifugal separator. Hence, also the second fluid connection 95 is rotationally fixed during use of the modular centrifugal separator 2.

The purpose of the engagement between the lid 54 and the second stationary portion 84 is to prevent the second stationary portion 84 from rotating during use of the modular centrifugal separator 2.

Moreover, the engagement between the lid 54 and the second stationary portion 84 contributes to positioning the exchangeable separation insert 6 in the base unit 4. In the closed position of the lid 54, the lid 54 presses the second stationary portion 84 towards the rotor casing 82, such that the seals within the exchangeable separation insert 6 provide their intended sealing function.

Moreover, the second stationary portion 84 may be releasably engaged with the stationary frame 8, and the second stationary portion 84 may be arranged in a second proximal position along the axial direction, counter to the bias in the second direction 71. The second proximal position is closer to the rotor casing 82 than a second distal end position of the second stationary portion 84 provided in an unmounted state of the exchangeable separation insert 6 and as shown in FIG. 2.

Thus, the exchangeable separation insert 6 is compressed by positioning the second stationary portion 84, against the bias, towards the rotor casing 82 in the second proximal position counter to the bias in the second direction 71. The bias of the second stationary portion 84 in the second direction 71, contributes to securely position the second stationary portion 84 in the stationary frame 8.

Schematically, in FIG. 4 it is shown how the at least one spring element 142 of the second set of springs 140 has been compressed when the second stationary portion 84 is arranged in the second proximal position.

The lid 54 may engage with the second stationary portion 84 in a number of different ways. For instance, the second stationary portion 84 may be provided with a radial recess 134 and the lid 54 may be provided with a protrusion 136 extending into the radial recess 134. Alternatively, or additionally, e.g. the second stationary portion 84 may be provided with an axial flange and the lid 54 may abut against the axial flange.

Schematically, also, in FIG. 4 it is shown how the at least one spring element 156 of the third set of springs 154 has been compressed when the first stationary portion 86 is arranged in the second proximal position.

The rotatable member 16 comprises a frustoconical wall member 68 having an imaginary apex in a region of the first axial end 24 of the rotatable member 16. A portion of the exchangeable separation insert 6 has a conical or frustoconical shape. The conical or frustoconical portion of the exchangeable separation insert 6 is supported by the is frustoconical wall member 68. The conical or frustoconical portion of the exchangeable separation insert 6 may be derived from the frustoconical shape of the separation discs 92 arranged in the separation space 88 of the rotor casing 82.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the invention, as defined by the appended claims.

The invention claimed is:

1. An exchangeable separation insert for a modular centrifugal separator, the exchangeable separation insert comprising a rotor casing rotatable about an axis of rotation and a first stationary portion, wherein the rotor casing delimits a separation space and comprises frustoconical separation discs arranged in the separation space, wherein a first fluid passage extends through the first stationary portion into the separation space, wherein the axis of rotation extends along an axial direction and the rotor casing has a first axial end portion and a second axial end portion, wherein the first stationary portion is arranged at the first axial end portion, wherein the first stationary portion is movable in the axial direction toward and away from the rotor casing, and wherein the first stationary portion is biased in a first direction away from the rotor casing along the axial direction.

2. The exchangeable separation insert according to claim 1, wherein the first stationary portion comprises a first set of springs, the first set of springs comprising at least one spring element, and wherein the at least one spring element of the first set of springs is arranged in the first stationary portion such that when energy is stored in the at least one spring element of the first set of springs, the first stationary portion is biased in the first direction away from the rotor casing along the axial direction.

3. The exchangeable separation insert according to claim 2, comprising a first sealing member, wherein the first sealing member seals the first fluid passage in a transition between the first stationary portion and the rotor casing.

4. The exchangeable separation insert according to claim 3, wherein the first sealing member comprises a first stationary sealing element provided with a first stationary sealing surface arranged in the first stationary portion and a first rotatable sealing element provided with a first opposite sealing surface arranged in the rotor casing, and wherein the first stationary sealing surface abuts against the first opposite sealing surface.

5. The exchangeable separation insert according to claim 4, wherein the first stationary portion is axially displaceable in relation to the first stationary sealing element, and wherein the at least one spring element of the first set of springs is arranged between the first stationary portion and the first stationary sealing element such that when energy is stored in the at least one spring element of the first set of springs, the first stationary portion is biased in the first direction away from the rotor casing along the axial direction and the first stationary sealing element is pressed against the first rotatable sealing element.

6. The exchangeable separation insert according to claim 1, comprising a first stop mechanism for preventing the first stationary portion from moving in the first direction away from the rotor casing along the axial direction beyond a first distal end position.

7. The exchangeable separation insert according to claim 6, wherein the first stop mechanism comprises a first protrusion fixed in relation to the first stationary portion and extending in a radial direction, and a second protrusion fixed in relation to the rotor casing and extending in a radial direction, and wherein the first and second protrusions are configured to abut against each other when the first stationary portion is in the first distal end position.

8. The exchangeable separation insert according to claim 2, comprising a second stationary portion, wherein a second fluid passage extends through the second stationary portion into the separation space, wherein the second stationary portion is arranged at the second axial end portion of the rotor casing, wherein the second stationary portion is movable in the axial direction toward and away from the rotor casing, and wherein the second stationary portion is biased in a second direction away from the rotor casing along the axial direction.

9. The exchangeable separation insert according to claim 8, wherein the second stationary portion comprises a second set of springs, the second set of springs comprising at least one spring element, and wherein the at least one spring element of the second set of springs is arranged in the second stationary portion such that when energy is stored in the at least one spring element of the second set of springs, the second stationary portion is biased in the second direction away from the rotor casing along the axial direction.

10. The exchangeable separation insert according to claim 9, comprising a second sealing member, wherein the second sealing member seals the second fluid passage in a transition between the second stationary portion and the rotor casing.

11. The exchangeable separation insert according to claim 10, wherein the second sealing member comprises a second stationary sealing element provided with a second stationary sealing surface arranged in the second stationary portion and a second rotatable sealing element provided with a second opposite sealing surface arranged at the rotor casing, and wherein the second stationary sealing surface abuts against the second opposite sealing surface.

12. The exchangeable separation insert according to claim 11, wherein the second stationary portion is axially displaceable in relation to the second stationary sealing element, and wherein the at least one spring element of the second set of springs is arranged between the second stationary portion and the second stationary sealing element such that when energy is stored in the at least one spring element of the second set of springs, the second stationary portion is biased in the second direction away from the rotor casing along the axial direction and the second stationary sealing element is pressed against the second rotatable sealing element.

13. The exchangeable separation insert according to claim 9, comprising a second stop mechanism for preventing the second stationary portion from moving in the second direction away from the rotor casing along the axial direction beyond a second distal end position.

14. The exchangeable separation insert according to claim 13, wherein the second stop mechanism comprises a third protrusion fixed in relation to the second stationary portion and extending in a radial direction, and a fourth protrusion fixed in relation to the rotor casing and extending in a radial direction, and wherein the third and fourth protrusions are configured to abut against each other when the second stationary portion is in the second distal end position.

15. The exchangeable separation insert according to claim 10, wherein a third fluid passage extends through the first stationary portion into the separation space, wherein the exchangeable separation insert comprises a third sealing member, and wherein the third sealing member at least partially seals the third fluid passage in a transition between the first stationary portion and the rotor casing.

16. The exchangeable separation insert according to claim 15, wherein the third sealing member comprises a third stationary sealing element provided with a third stationary sealing surface arranged in the first stationary portion and a third rotatable sealing element provided with a third opposite sealing surface arranged in the rotor casing, and wherein the third stationary sealing surface abuts against the third opposite sealing surface.

17. The exchangeable separation insert according to claim 9, wherein the first stationary portion comprises a third set of springs, the third set of springs comprising at least one spring element, and wherein the at least one spring element of the third set of springs is arranged in the first stationary portion such that when energy is stored in the at least one spring element of the third set of springs, the first stationary portion is biased in the first direction away from the rotor casing along the axial direction.

18. The exchangeable separation insert according to claim 17, wherein the first stationary portion is axially displaceable in relation to the third stationary sealing element, and wherein the at least one spring element of the third set of springs is arranged between the first stationary portion and the third stationary sealing element such that when energy is stored in the at least one spring element of the third set of springs, the first stationary portion is biased in the first direction away from the rotor casing along the axial direction and the third stationary sealing element is pressed against the third rotatable sealing element.

19. A modular centrifugal separator configured for separating a liquid feed mixture into a heavy phase and light phase, comprising the exchangeable separation insert according to claim 1 and a base unit, wherein the base unit comprises a stationary frame, a rotatable member, and a drive unit for rotating the rotatable member, wherein the rotor casing of the exchangeable separation insert is releasably engaged inside the rotatable member, and the first stationary portion is releasably engaged with the stationary frame, wherein the first stationary portion is arranged in a first proximal position along the axial direction, counter to the bias in the first direction, and wherein the first proximal position is closer to the rotor casing than a first distal end position of the first stationary portion provided in an unmounted state of the exchangeable separation insert.

20. The modular centrifugal separator according to claim 19, wherein the exchangeable separation insert comprises a second stationary portion, wherein a second fluid passage extends through the second stationary portion into the separation space, wherein the second stationary portion is arranged at the second axial end portion of the rotor casing, and wherein the second stationary portion is biased in a second direction away from the rotor casing along the axial direction, wherein the second stationary portion is releasably engaged with the stationary frame, wherein the second stationary portion is arranged in a second proximal position along the axial direction, counter to the bias in the second direction, and wherein the second proximal position is closer to the rotor casing than a second distal end position of the second stationary portion provided in an unmounted state of the exchangeable separation insert.

* * * * *